US008295984B2

(12) United States Patent
Heisele et al.

(10) Patent No.: US 8,295,984 B2
(45) Date of Patent: Oct. 23, 2012

(54) METHOD FOR DETECTING THE POSITION OF A CLOSURE ELEMENT IN A WATER DISTRIBUTION MECHANISM

(75) Inventors: Bernd Heisele, Sontheim (DE); Anton Oblinger, Wertingen (DE); Andreas Reiter, Finningen (DE); Michael Rosenbauer, Reimlingen (DE); David Semerad, Holzheim (DE); Christian Wolf, New Bern (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 343 days.

(21) Appl. No.: 12/594,375

(22) PCT Filed: Apr. 1, 2008

(86) PCT No.: PCT/EP2008/053869

§ 371 (c)(1),
(2), (4) Date: Oct. 2, 2009

(87) PCT Pub. No.: WO2008/125482

PCT Pub. Date: Oct. 23, 2008

(65) Prior Publication Data

US 2010/0121497 A1 May 13, 2010

(30) Foreign Application Priority Data

Apr. 12, 2007 (DE) ..... 10 2007 017 274

(51) Int. Cl.
*G05D 11/00* (2006.01)

(52) U.S. Cl. ..... 700/282

(58) Field of Classification Search ..... 700/281, 700/282, 283; 702/45; 73/1.16, 1.25; 137/51; 251/129.04

See application file for complete search history.

(56) References Cited

U.S. PATENT DOCUMENTS

| | | | | |
|---|---|---|---|---|
| 6,178,997 | B1 * | 1/2001 | Adams et al. | 137/487.5 |
| 6,601,593 | B2 * | 8/2003 | Deiss et al. | 134/25.2 |
| 6,837,271 | B1 * | 1/2005 | Saint | 137/624.12 |
| 7,047,986 | B2 * | 5/2006 | Ertle et al. | 134/56 D |
| 7,454,985 | B2 * | 11/2008 | Marioni | 73/861.77 |
| 2004/0103926 | A1 | 6/2004 | Ha | |
| 2006/0118745 | A1 * | 6/2006 | Tuin et al. | 251/129.04 |

FOREIGN PATENT DOCUMENTS

| | | | |
|---|---|---|---|
| DE | 4418721 | A1 | 11/1995 |
| DE | 10065571 | A1 | 7/2002 |
| DE | 19857101 | B4 | 4/2004 |
| EP | 1088509 | A1 | 9/2000 |
| EP | 1767135 | A1 | 8/2006 |

* cited by examiner

*Primary Examiner* — John R. Cottingham
*Assistant Examiner* — Chad Rapp
(74) *Attorney, Agent, or Firm* — James E. Howard; Andre Pallapies

(57) ABSTRACT

A method and a device are provided for detecting the position of a closure element of a movement reversal device in a dishwasher. The device determines the position of a closure element via a comparison of a value corresponding to a predefined reference position of the closure element with a signal value of a circulation pump of the dishwasher.

20 Claims, 3 Drawing Sheets

METHOD FOR DETECTING THE POSITION OF A CLOSURE ELEMENT IN A WATER DISTRIBUTION MECHANISM

BACKGROUND OF THE INVENTION

The present invention relates to a method for detecting the position of a closure element in a changeover device of a dishwasher. The term "water diverter" can be employed synonymously with the term "changeover device". The function of the changeover device is to distribute a rinsing fluid among various spraying systems or spraying levels inside a washing container of the dishwasher. A circulating pump is used to transport the rinsing fluid. A drive device driven by a control device changes the position of the closure element. The invention relates further to a device for detecting the closure element's position.

A changeover device of said type is known from DE 198 57 101 B4. The closure element's position is detected via a rotation-speed sensor on a circulating pump located in front of the changeover device. Said sensor is linked to an electronic control device that ascertains the valve body's position by way of the pump's rotation speed. Use is therein made of the fact that after the pump has stopped working, either regular running thereof owing to a quite small amount of fluid being fed into a lower spraying system or rough running thereof owing to a quite large amount of fluid being fed into an upper spraying system will be detected by the rotation-speed sensor by way of the ascertained rotation speed, then conveyed to the electronic control device via a corresponding control signal. Conveying of the pump's regular or rough running enables the electronic control device to precisely and reliably determine the valve body's position in one of two closure positions. What is disadvantageous about that embodiment variant is on the one hand the highly complex structure of the changeover device, because both the outer walls and additional elements inside the changeover device have to insure valve-body guiding. On the other hand, there must be at least one sensor in the region of the circulating pump. That results overall in higher costs for producing the dishwasher.

BRIEF SUMMARY OF THE INVENTION

The object of the present invention is to disclose a more economical method and a device for detecting the position of a closure element in a changeover device of a dishwasher so that the closure element's position will be detected quickly and reliably after a fault incident.

Said object is inventively achieved by means of a method having the features of claim 1. According thereto, for detecting the position of the changeover device's closure element, said element is moved during a first step by the drive device, for example by turning. At a second step, performed during the first, the control device ascertains at least one signal value of the circulating pump. The signal value can be a performance value of the circulating pump, for example pressure, load angle, or vibration. The control device in any event monitors the performance values of the circulating pump while it is operating in order to control its rotation speed. At a third step it compares the ascertained signal values with a value stored in the control device for a reference position of the closure element. The third step can likewise already be performed during the second step or not until after it. The first, second, and third step can be performed continuously or discontinuously, with any combinations of continuously and discontinuously performed steps being possible.

The reference position defines a specific position of the closure element relative to the water diverter. Said reference position is stored in the control device on a power-failure-proof basis and programs can be launched from it or resumed after a fault incident.

The closure element is in contrast to the prior art actively driven in the changeover device by the inventive method. That has the advantage that the closure element's position can be quickly and reliably determined after a fault incident by a defined course of movement. Only the closure element's position within a defined course of movement will for that purpose continue being changed until the reference position has been reached. The closure element can be selectively driven again from the reference position.

A further advantage lies in the changeover device's simple structure. All it requires is a housing, having one inlet and various outlets, and a closure element that is moved by a drive device. It is possible to dispense with sensor systems for detecting the position of the closure element, whether they be located directly in the water diverter or, for indirect registering, in the circulating pump. The housing can be, for example, a hollow cylinder in which a discoid closure element is turned by, for instance, an electric motor. Simple geometric shapes or standard parts are economical. Moreover, fewer individual parts will be required overall, as a result of which the assembly effort will be reduced. What is more, the reduction in parts, particularly moving parts, will result in fewer sources of disruption and fewer frictional losses in the changeover device.

According to an advantageous embodiment variant of the invention, the closure element is stopped in the reference position in order to synchronize its position with the changeover device. That means that the closure element's position will be harmonized with reference elements such as, for example, the outlets on the changeover device's housing. From the reference position the closure element can then again be driven in a defined manner as a function of a program cycle. The reference position preferably corresponds to a position of the closure element, which position is assumed also during a program cycle relative to the changeover device's housing. It is thereby insured that the program cycle can be resumed as soon as possible after a disruptive incident because an additional step of the method for orienting the closure element from the reference position is dispensed with.

According to a further advantageous embodiment variant of the invention, the closure element is synchronized using openings as reference elements in the changeover device. The openings are changeover-device outlets or exits through which the rinsing fluid is pumped to the spraying systems in the dishwasher's washing container. The closure element likewise has openings which as a function of its position align with the openings of the changeover device and so release one or more exits of the changeover device. The amount of rinsing fluid which the circulating pump is able to pump through the changeover device per unit of time hence also changes. If only a few openings are released, or only a small opening cross-section, there will be an increase in the rinsing-fluid pressure in the changeover device and consequently also in the circulating pump's performance values. The performance values accordingly change as a function of the released openings, with there being a specific performance value for each position of the closure element. That correlation can be advantageously used for determining the position of the closure element.

In a particularly advantageous embodiment variant of the invention, a maximum volume flow is set. That is done by putting the closure element into its reference position, with the maximum volume flow occurring in that reference position owing to a corresponding embodiment of the closure element. The circulating pump's current-consumption value is at its maximum in that position. That is the case when, for example, a centrifugal pump is used. Because the pump's power consumption is limited, the current-consumption value will also rise only to a maximum value. Said value can hence advantageously represent the signal value stored for the reference position in the control device, which value it continuously compares with the measured signal values during position detecting. Because the maximum current-consumption value is attained only in the reference position, clear determining thereof will always be insured. Depending on the kind and type of pump, the maximum current consumption can, however, also occur at a volume flow less than the maximum. The reference position and/or closure element will in that case be embodied accordingly.

Apart from the current consumption it is basically also possible to ascertain other signal values such as, for instance, rotation speed, pressure, load angle, or vibration on the circulating pump. The circulating pump's current consumption is, through, preferably ascertained by the control device as the signal value during position detecting. Additional sensors in or on the circulating pump can be dispensed with when the current consumption is ascertained as the signal value. The current consumption will in any event be registered by the control device when the circulating pump is being driven as it is used for influencing performance or controlling rotation speed. Additional parts on the circulating pump can be dispensed with, and costs as well as additional sources of faults hence reduced.

The object of the invention is achieved also by means of a device for detecting the position of a closure element in a dishwasher, which device includes a changeover device having a closure element located therein, a circulating pump, and a control device linked to the circulating pump and to a drive device for the closure element. The device further inventively has means for registering and evaluating signal values of the circulating pump as a function of the closure element's position and is moreover free of sensors. The invention therefore refrains from registering the closure element's position directly using sensors. Rather it follows the principle of registering a characteristic signal value or performance value of the circulating pump and deriving therefrom the closure element's position in the water diverter.

Because characteristics of the circulating pump have to be data-registered in any event for controlling it, the proposed device will necessitate no extra structural effort. Rather it relies on largely existing devices so that it will be more economical compared with an additional sensor system.

BRIEF DESCRIPTION OF THE DRAWINGS

The inventive method and associated device are described by way of example in more detail below with the aid of drawings.

DETAILED DESCRIPTION OF EXEMPLARY EMBODIMENTS OF THE PRESENT INVENTION

Figure 1:
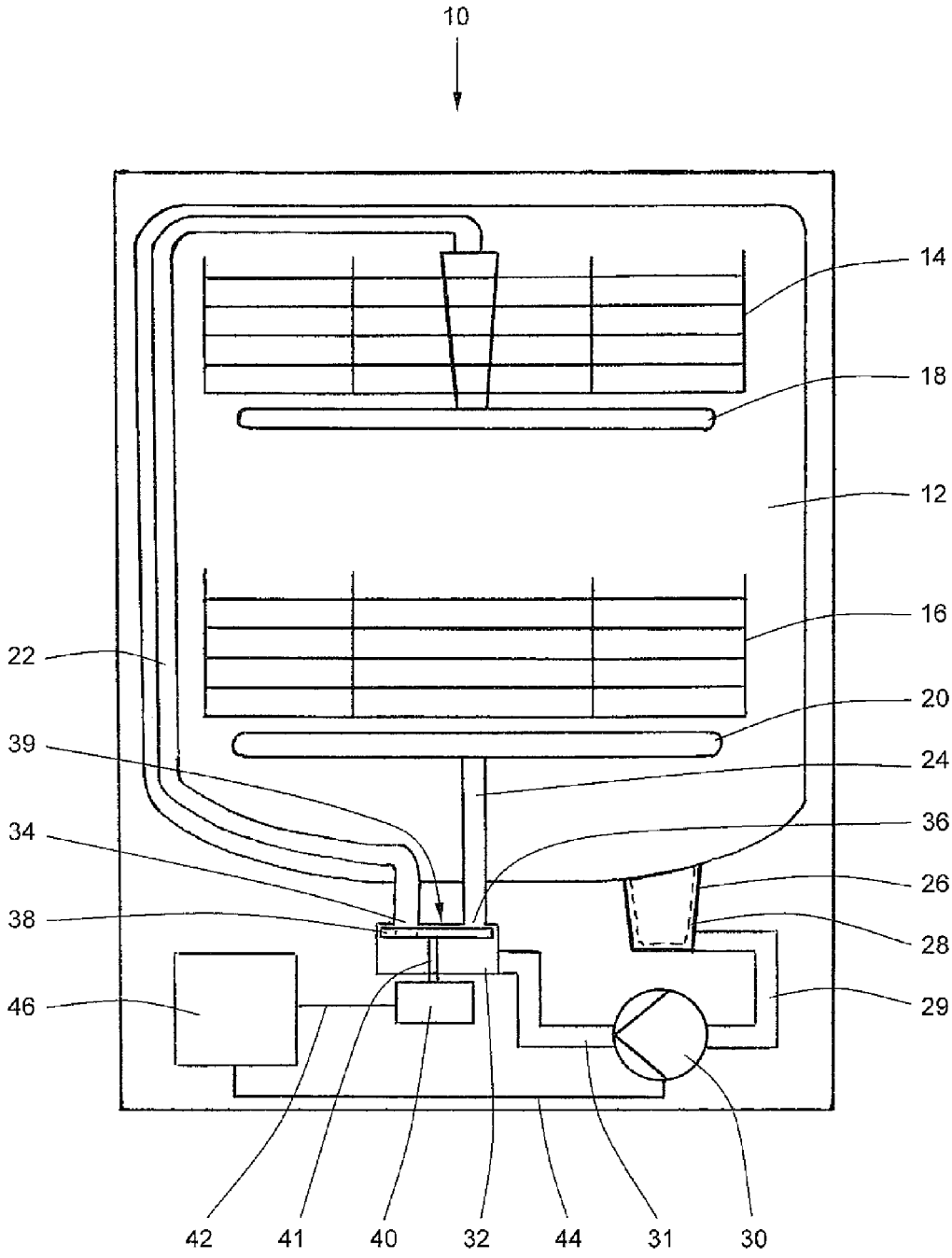
FIG. 1 is a schematic view of a dishwasher with the components essential for the inventive method.

FIG. 1 is a schematic of a dishwasher 10 having a washing container 12 in which are located an upper basket 14 and a lower basket 16. Mounted rotatably below the upper basket 14 is an upper spraying system 18 and below the lower basket 16 is a lower spraying system 20 each in the form of a spraying arm. The upper spraying system 18 is supplied via a feeder line 22 and the lower spraying system via a feeder line 24 with rinsing fluid. Located below the washing container 12 is a sump 26 having a filter insert 28 that is linked via a fluid line 29 to a circulating pump 30. The circulating pump 30 is connected via a fluid line 31 to a water diverter 32. It has a covering surface 39 having two openings 34, 36, with the opening 34 being linked to the feeder line 22 and the opening 36 to the feeder line 24.

Mounted rotatably inside the cylindrical water diverter 32 parallel to the covering surface 39 is a discoid closure element 38. It is arranged in a rotationally fixed manner on a motor shaft 41 of an electric motor 40. The electric motor 40 and circulating pump 30 are linked each via an electric line 42, 44 to a control device 46.

Figure 2:
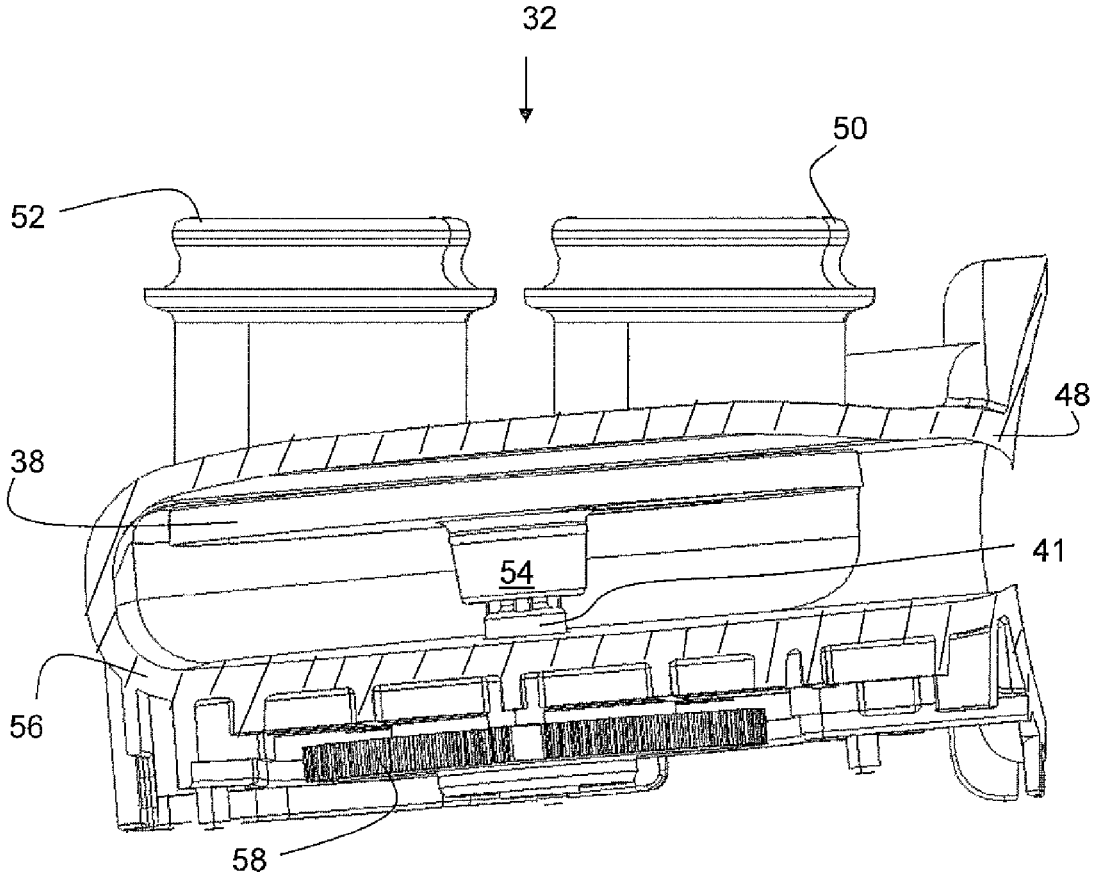
FIG. 2 is a partially cut-away representation of a changeover device.
Figure 3:
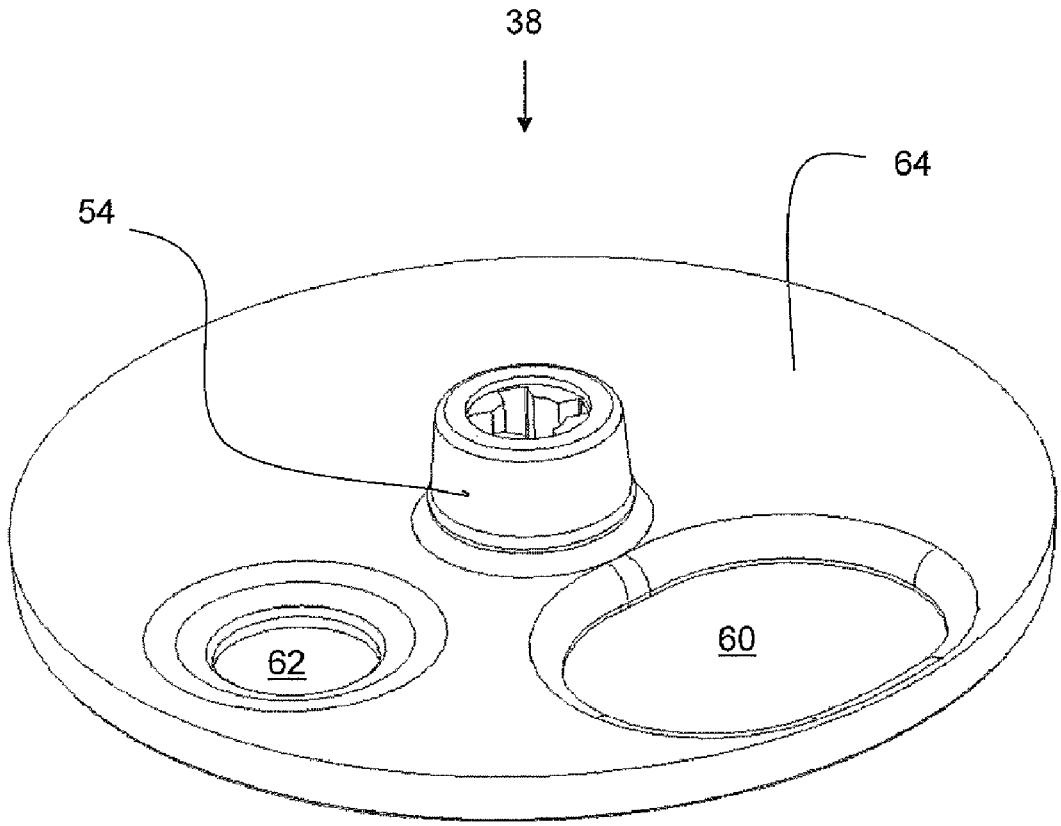
FIG. 3 shows a closure element.

FIG. 2 is a partially cut-away view of an embodiment variant of the water diverter 32. It has one inlet connection 48 and two outlet connections 50, 52. Located inside the water diverter 32 is a discoid closure element 38 that is linked via a flange 54 to the shaft 41. FIG. 3 is an isolated view of the closure element 38. It includes the centric flange 54 and, eccentrically, an opening 60 having a large cross-section and an opening 62 having a small cross-section. The closure element 38 is mounted rotatably in front of the outlet connections 50, 52 in the water diverter 32 so that the openings 60, 62 optionally or jointly align with the connections 50, 52 or close them.

The shaft 41 (FIG. 2) is ducted fluid-tightly through a housing 56 of the water diverter 32. Attached outside the housing 56 to the shaft 41 is a toothed wheel 58 which as a link to the electric motor 40 (FIG. 1) serves as the drive of the closure element 38.

The circulating pump 30 ducts rinsing fluid to the water diverter 32 via the inlet connection 48, which fluid exits the water diverter 32 again via the outlet connections 50, 52 and the corresponding feeder lines 22, 24. The amount of rinsing fluid expelled through one or both outlet connections 50, 52 can be controlled by means of the differently wide openings 60, 62 of the closure element 38. The outlet connections 50, 52 can hence be alternately or jointly released or closed while the dishwasher 10 is operating.

The rinsing fluid in the dishwasher 10 (FIG. 1) circulates during a rinsing operation. The circulating pump 30 draws in the rinsing fluid through the line 29 via the sump 26 and pumps it onward through the line 31 into the water diverter 32. The control device 46 therein controls the electric motor 40 program-dependently in such a way that the closure element 38 will open or close the openings 34 and 36. Depending on specific driving, the feeder line 22 or 24 or both will be supplied with rinsing fluid.

The electric motor 40 can no longer be supplied with power in the event of a fault incident, for example a power outage. The closure element 38 will thereupon stop in an unspecified position. The assignment of the position of the closure element 38 relative to the water diverter 32 required by the control device 46 for driving the closure element 38 will be lost. Rinsing fluid that flows back into the changeover device from the lines 22, 24 as a consequence of gravity can furthermore additionally alter the closure element's position. Precise detecting of the position of the closure element 38 by the control device 46 is necessary to be able to insure a fast and smooth transition to the program in progress after the fault incident.

The closure element 38 is for that purpose moved into a reference position. It defines a specific position of the closure element 38 inside the water diverter 32 from which a program cycle of the washer can be restarted. The current consumption of the circulating pump 32 is at its maximum in said position because it is pumping the fluid ineffectively against the closed openings 34, 36 and hence counter to a maximum resistance. Because the maximum current-consumption value is attained only in the reference position, clear determining thereof will be insured at all times. The control device 46 registers the current consumption in any event while the circulating pump 30 is being driven in order to use it for influencing the performance or controlling the rotation speed of the circulating pump 30. The current-consumption value of the circulating pump 30 that characterizes the reference position is preset and stored in the control device 46 on a power-failure-proof basis.

For detecting the position of the closure element 38 in the water diverter 32 after a fault incident, the control device 46 first starts the circulating pump 30 and then drives the electric motor 40 in such a way that it will effect a complete revolution of the shaft 41 along with the closure element 38. The control device meanwhile continuously ascertains the current-consumption value of the circulating pump 30 and compares said value with that stored in the control device 46 for the reference position of the closure element 38. The openings 34, 36 are released or, as the case may be, closed by the closure element 38 during the 360-degree revolution. The value of the current consumption of the circulating pump 30 therein changes. The washer's program cycle can be resumed as soon as the current-consumption value of the circulating pump 30 stored for the reference position has been reached. A sensor for registering the precise position of the closure element 38 in the water diverter 32 or circulating pump 30 is therefore dispensable.

The reference position corresponds preferably to a position of the closure element 38 that is assumed also during a program cycle relative to the openings 34, 36. It will thereby be insured that the program cycle can be resumed as soon as possible after a disruptive incident because additionally orienting the closure element 38 from the reference position into a start position for the program cycle is dispensed with.

Being an exemplary embodiment, the above device 32 that has been described in detail can be extensively modified in a customary manner by a person skilled in the relevant art without departing from the inventive scope. The specific embodiment of the closure element 38 can in particular also have a form other than that described here. For example the number of the openings 60, 62 as well their size and shape can differ in different embodiment variants. Use of the indefinite article "a" or "an" furthermore does not preclude the possible multiple presence of the relevant features.

List of References

10 Dishwasher
12 Washing container
14 Upper basket
16 Lower basket
18 Upper spraying system
20 Lower spraying system
22 Feeder line to the upper spraying system
24 Feeder line to the lower spraying system
26 Sump
28 Filter insert
29,31 Fluid line
30 Circulating pump
32 Water diverter
34,36 Opening
38 Closure element
39 Covering surface
40 Electric motor
41 Shaft
42,44 Electric line
46 Control device
48 Inlet connection
50,52 Outlet connections
54 Flange
56 Housing
58 Toothed wheel
60,62 Openings in the closure element
64 Region free of openings

The invention claimed is:

1. A method for detecting a current position of a closure element of a changeover assembly in a dishwasher, the method comprising:

controlling a drive device to move the closure element, the drive device and the closure element being part of the changeover assembly that has fluid fed to it by a circulating pump and that effects distribution of the fluid into an area of the dishwasher and the drive device being controlled by a control device to move the closure element into different positions relative to an outlet of the changeover assembly such that the closure element permits or blocks fluid through the outlet;

ascertaining a signal value of the circulating pump when the closure element is in the current position, the signal value being associated with a characteristic of the circulating pump that obtains during the step of controlling a drive device to move the closure element;

comparing the ascertained signal value with a reference value stored in the control device for a respective reference position of the closure element; and using the results of the comparing step to detect the current position of the closure element.

2. The method as claimed in claim 1 and further comprising moving the closure element to the reference position following the step of comparing the ascertained signal value with the reference value if there is a difference between the ascertained signal value and the reference value.

3. The method as claimed in claim 2, wherein the step of controlling a drive device to move the closure element includes controlling the drive device to move a closure element that is synchronized with reference to a plurality of outlets in the changeover assembly.

4. The method as claimed in claim 2, wherein the closure element is stopped in the reference position.

5. The method as claimed in claim 4, wherein stopping the closure element in the reference position includes stopping the closure element in a position at which a maximum volume flow of the circulating pump exists.

6. The method as claimed in claim 2, wherein stopping the closure element in the reference position includes stopping the closure element in a position at which a minimum volume flow exists.

7. The method as claimed in claim 6, wherein the minimum volume flow is zero.

8. The method as claimed in claim 2 wherein the reference value is stored in the control device on a power-failure-proof basis.

9. The method as claimed in claim 2, wherein the reference position is a position of the closure element at which program cycles of the dishwasher are launched.

10. The method as claimed in claim 1 and further comprising measuring the electrical current consumption of the circulating pump as the signal value.

11. An apparatus for detecting the current position of a closure element of a changeover assembly in a dishwasher, the apparatus comprising:

a component for registering a signal value of a circulating pump of a dishwasher, the signal value being associated with a characteristic of the circulating pump that obtains during a movement of a closure element by a drive device controlled by a control device, the drive device, the closure element, and the control device being part of a changeover assembly that has fluid fed to it by the circulating pump and that effects distribution of the fluid into an area of the dishwasher with the drive device being controlled by the control device to move the closure element into different positions relative to an outlet of the changeover assembly such that the closure element permits or blocks fluid through the outlet of the changeover assembly; and a component for evaluating signal values of the circulating pump as a function of the position of the closure element, wherein the component for evaluating detects the current position of the closure element by comparing the signal value at the current position with a reference value stored in the dishwasher.

12. The apparatus as claimed in claim 11 and further comprising a measuring device for registering the electrical current consumption of the circulating pump, wherein the electric current consumption of the circulating pump at the current position is the signal value at the current position, and the electric current consumption of the circulating pump at the reference position is the reference value.

13. The apparatus as claimed in claim 11, wherein the control device controls the drive control to move the closure element to the reference position after the current position is detected if there is a difference between the signal value at the current position and the reference value.

14. The apparatus as claimed in claim 13, wherein the control device controls the drive control to stop the closure element in the reference position.

15. The apparatus as claimed in claim 14, wherein the reference position is a position at which a maximum volume flow of the circulating pump exists.

16. The apparatus as claimed in claim 14, wherein the reference position is a position at which a minimum volume flow of the circulating pump exists.

17. The apparatus as claimed in claim 14, wherein the control device stores the reference value on a power-failure-proof basis, and the reference position is a position of the closure element at which program cycles of the dishwasher are launched.

18. The apparatus as claimed in claim 11, wherein the closure element is synchronized with reference to a plurality of outlets in the changeover assembly.

19. The apparatus as claimed in claim 11, wherein the control device stores the reference value on a power-failure-proof basis.

20. The apparatus as claimed in claim 11, wherein the reference position is a position of the closure element at which program cycles of the dishwasher are launched.

* * * * *